US005631048A

United States Patent [19]

Kinose et al.

[11] Patent Number: 5,631,048

[45] Date of Patent: May 20, 1997

[54] METHOD OF FORMING A THIN FILM ON THE SURFACE OF A SUBSTRATE USING A ROLL COATER

[75] Inventors: Kazuo Kinose; Kazuto Ozaki, both of Shiga; Tsuyoshi Okumura, Shiga-ken, all of Japan

[73] Assignee: Dainippon Screen Manufacturing Co., Ltd., Japan

[21] Appl. No.: 397,545

[22] Filed: Feb. 28, 1995

Related U.S. Application Data

[63] Continuation of Ser. No. 71,772, Jun. 4, 1993, abandoned.

[30] Foreign Application Priority Data

Jun. 10, 1992 [JP] Japan ..... 4-177382

[51] Int. Cl.[6] ..... B05D 1/28

[52] U.S. Cl. ..... 427/428; 118/210; 118/211; 118/244; 118/248; 118/258; 118/261; 118/262

[58] Field of Search ..... 118/210, 211, 118/244, 248, 258, 261, 262; 427/428

[56] References Cited

U.S. PATENT DOCUMENTS

| | | | |
|---|---|---|---|
| 3,793,983 | 2/1974 | Shelestak | 118/244 |
| 4,339,481 | 7/1982 | Beekhuis | 118/262 |
| 4,347,269 | 8/1982 | Keep | 118/262 |
| 4,442,791 | 4/1984 | Adachi et al. | 118/258 |
| 4,737,378 | 4/1988 | Narita et al. | 118/262 |
| 4,796,559 | 1/1989 | Lohse | 118/210 |
| 5,178,912 | 1/1993 | Piacente et al. | 118/244 |

FOREIGN PATENT DOCUMENTS

| | | |
|---|---|---|
| 53-4848 | 2/1975 | Japan . |
| 2-133470 | 6/1989 | Japan . |
| 3-151082 | 6/1991 | Japan . |

*Primary Examiner*—Katherine Bareford

*Attorney, Agent, or Firm*—Ostrolenk, Faber, Gerb & Soffen, LLP

[57] ABSTRACT

A method of forming a thin film on the surface of a substrate using a roll coater without forming a projection of the thin film near the rear edge of the substrate includes the steps of: loading a substrate on a stage, moving the stage in a predetermined direction up to a certain position where at least a portion of the surface of the substrate comes into contact with the applicator roll while controlling the operation of the roll coating apparatus so that the amount of coating fluid transferred per unit area from the applicator roll to the substrate surface is a predetermined value, and further moving the stage in the predetermined direction to cancel the contact between the surface of the substrate and the applicator roll while controlling the operation of the roll coating apparatus so that the amount of coating fluid transferred per unit area from the applicator roll to the substrate surface is relatively reduced. Until the stage reaches the certain position, a predetermined amount of coating liquid is supplied, and thereafter, a smaller amount of coating liquid is supplied to the surface of the substrate. For example, the transfer speed of the stage is increased while maintaining the rotation speed of the applicator roll at a constant level, or the rotating speed of the applicator roll is decreased while maintaining the transfer speed of the stage at a constant level.

6 Claims, 7 Drawing Sheets

METHOD OF FORMING A THIN FILM ON THE SURFACE OF A SUBSTRATE USING A ROLL COATER

This is a file wrapper continuation of application Ser. No. 08/071,772, filed on Jun. 4, 1993, now abandoned.

BACKGROUND OF THE INVENTION

1. Field of the Invention

The present invention relates to a method of applying a coating fluid such as photoresist liquid agent or polyimide resin onto the surface of a substrate such as a liquid crystal glass plate, an image sensor substrate, or a semiconductor substrate using a roll coater. More particularly, the present invention relates to a method of forming a thin film of uniform and predetermined thickness on the surface of a substrate with an applicator roll by bringing into contact or depressing and rotating the applicator roll relative to the surface of the substrate while the latter is conveyed in a horizontal direction.

2. Description of the Related Art

A conventional roll coater used for such an application is disclosed in Japanese Utility Model Laid-Open No. 2-133470, for example. This conventional roll coater includes a stage for holding a substrate by vacuum suction and transporting the same in a horizontal direction, a reservoir for storing coating fluid, and an applicator roll for applying onto the surface of a substrate coating fluid supplied from the reservoir through one or a plurality of coating fluid supplying rolls.

At least the cylindrical surface of the circumference of the applicator roll which holds a thin film of the supplied coating fluid is formed of an elastic material such as a rubber material.

Using a conventional roll coater, a thin film such as a photoresist film of a predetermined thickness is formed on the surface of a substrate as set forth in the hereinafter.

A substrate is held by vacuum suction on a stage and is conveyed in a horizontal direction by the stage. The applicator roll is rotated to have its circumferential cylindrical surface in contact with or depressed against the surface of the conveyed substrate, whereby the coating fluid is transferred from the circumferential cylindrical surface of the applicator roll to the surface of the substrate. When the circumferential cylindrical surface of the applicator roll is depressed against the surface of the substrate, a portion of the circumferential cylindrical surface thereof is deformed in an elastic manner.

With reference to FIG. 1 it is seen that by utilizing such a conventional method the coating fluid is applied in a greater amount at the peripheral edge of a substrate 1. Although undesirable, the rear or trailing of substrate 1 in the transportation direction x will have a greater amount of coating fluid applied to result in the formation of a projection 6. It is assumed that the thickness of projection 6 is $t_1$, and the thickness of a thin film 5 formed at the center portion of substrate 1 is t. The thickness $t_1$ is approximately 1.5 to 3 times the thickness of t.

Such a phenomenon was conventionally considered to be inherent in coating by using a roll coater. It was considered that this undesirable result or problem could not be avoided as long as a roll coater is used.

A substrate having a thin film formed thicker at the rear edge than at other portions will result in the following problem when a photoresist is employed as the coating fluid and following application of the coating fluid onto a substrate, contact exposure is carried out. In this process, sufficient adhesion between the exposure mask and the surface of the substrate cannot be obtained due to the above-described projection 6. As a result, the quality of the exposure is reduced. Furthermore, in the developing process following the degraded contact exposure degraded, there is a possibility that the projection 6 of the photoresist film on the substrate surface is not sufficiently developed and remains on the surface of the substrate 1.

SUMMARY OF THE INVENTION

Accordingly, an object of the present invention is to provide a method of forming a thin film on the surface of a substrate using a roll coater in a manner that will not adversely affect a succeeding process.

Another object of the present invention is to provide a method of forming a thin film on the surface of a substrate using a roll coater without generating an unnecessary thick portion at the rear edge of the substrate.

A further object of the present invention is to provide a method of forming a thin film on the surface of a substrate using a roll coater without generating an unnecessary projection of the thin film at the rear edge of the substrate.

Still another object of the present invention is to provide a method that utilized a roll coater to apply a thin fluid thinner on the surface of a substrate in the proximity of the rear edge thereof to prevent generation of an unnecessary projection of the thin film at the rear edge of the substrate.

A still further object of the present invention is to reduce the amount of thin fluid film applied by a mill coater per unit area onto the surface of a substrate at the proximity of the rear edge thereof in comparison with other portions of the substrate to prevent generation of an unnecessary projection of the thin film at the rear edge of the substrate.

A method according to the present invention is to be carried out in a roll coater including a stage for holding a substrate to convey the same on a predetermined transportation path, an applicator roll with at least the circumferential surface layer having elasticity and disposed above the transportation path, means for supplying coating fluid to the circumferential cylindrical surface of the applicator roll, and an applicator roll driving mechanism for rotating the circumferential cylindrical surface of the applicator roll and bring the latter against the surface of the substrate being transported by the stage. This method includes the steps of moving the stage in a predetermined direction to a certain position where at least a portion of the surface of the substrate comes into contact with the applicator roll. At the same time the roll coater operates so that the amount of coating fluid transferred from the applicator roll to the surface of the substrate per unit area becomes a predetermined value, and further moving the stage in the predetermined direction to cancel the contact between the surface of the substrate and the applicator roll while controlling the operation of the roll coater so that the amount of coating fluid transferred per unit area onto the surface of the substrate from the applicator roll is relatively reduced.

A predetermined amount of coating fluid is supplied to the surface of the substrate until the stage reaches a certain position. A reduced amount of coating fluid is supplied to the surface of the substrate downstream of the certain position. Therefore, the thickness of the film formed at the latter half portion of the substrate is less than the other portion so that projection of a film is less likely to occur at the rear edge of the substrate. Even if a projection is formed, the size is smaller in comparison with the conventional case. Therefore, the possibility of unfavorable contact between the substrate surface and the mask is reduced as is the possibility that of a resist portion is developed at the time of the photoresist developing process.

In order to reduce the amount of coating fluid supplied per unit area to the substrate surface during the application, the transportation speed of the stage may be increased while maintaining the rotating speed of the applicator roll at a constant level, or the rotating speed of the applicator roll may be reduced while maintaining the transportation speed of the stage constant. Alternatively, the amount of coating fluid adhering to the circumference of the applicator roll may be regulated using a doctor or the like.

The foregoing and other objects, features, aspects and advantages of the present invention will become more apparent from the following detailed description of the present invention when taken in conjunction with the accompanying drawings.

DETAILED DESCRIPTION OF THE PREFERRED EMBODIMENTS

Figure 2:
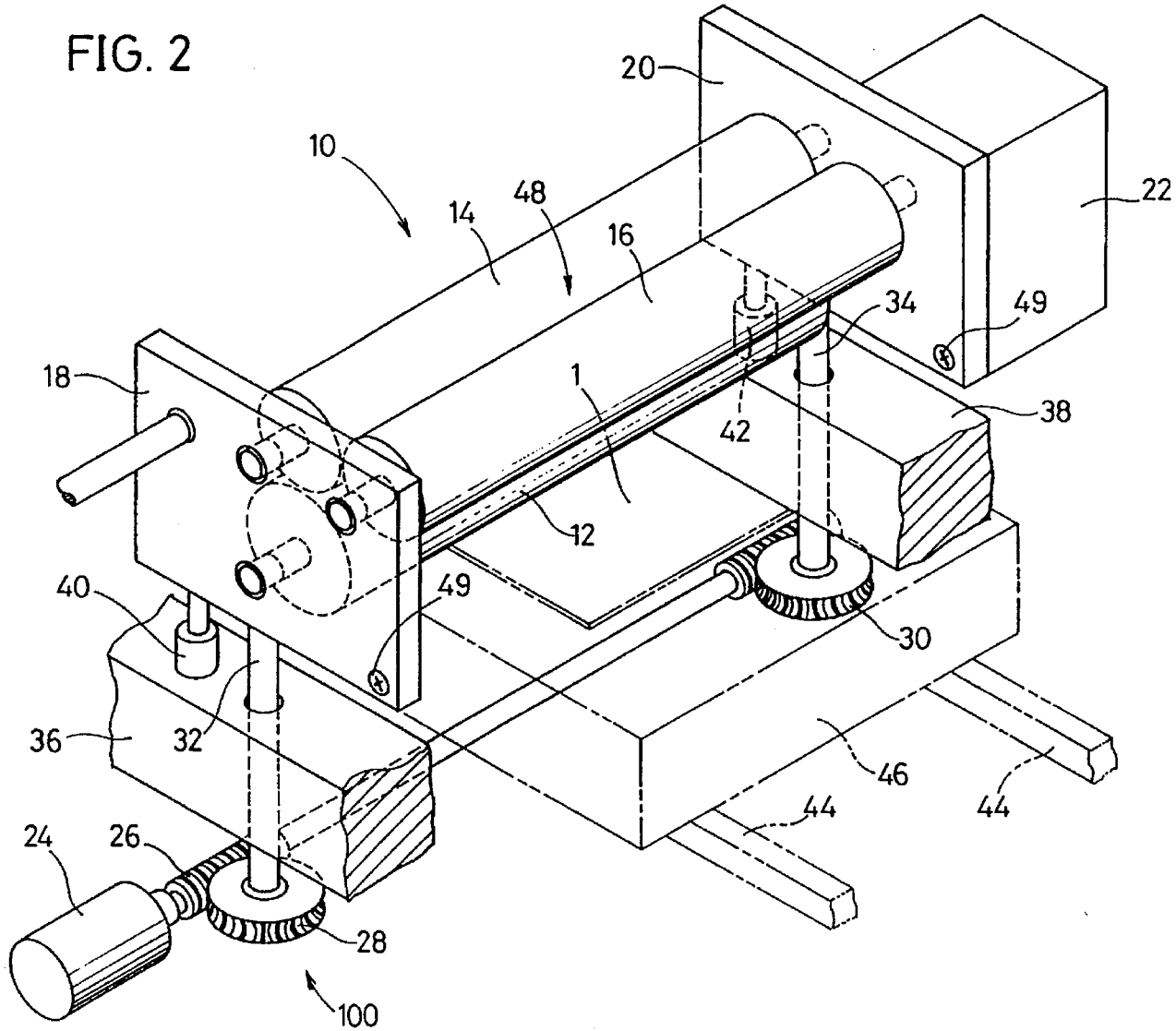
FIG. 2 is a perspective view of the main part of a roll coater for carrying out a method according to an embodiment of the present invention.
Figure 3:
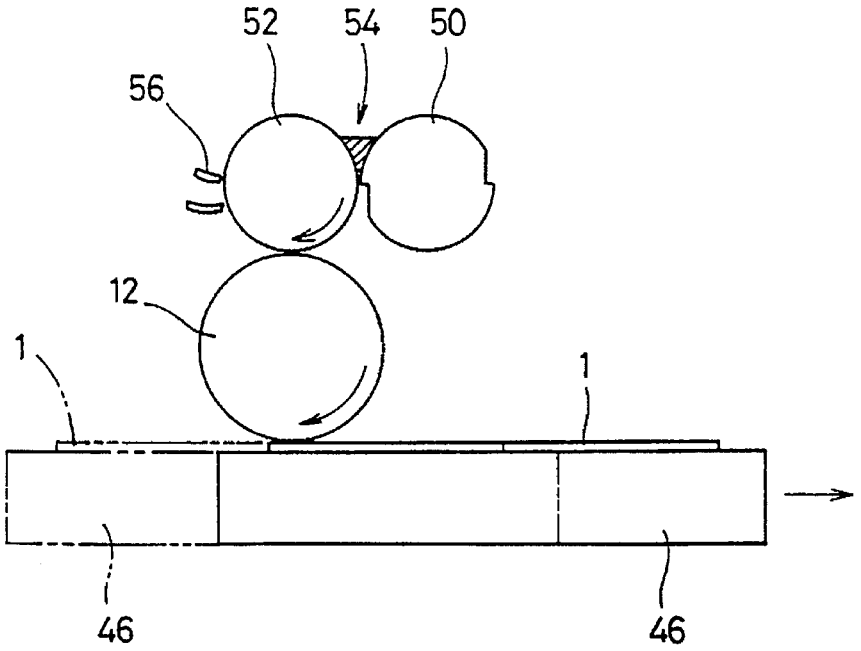
FIG. 3 schematically shows an example of a structure of a roll coater used in forming a thin film on a substrate.
Figure 4:
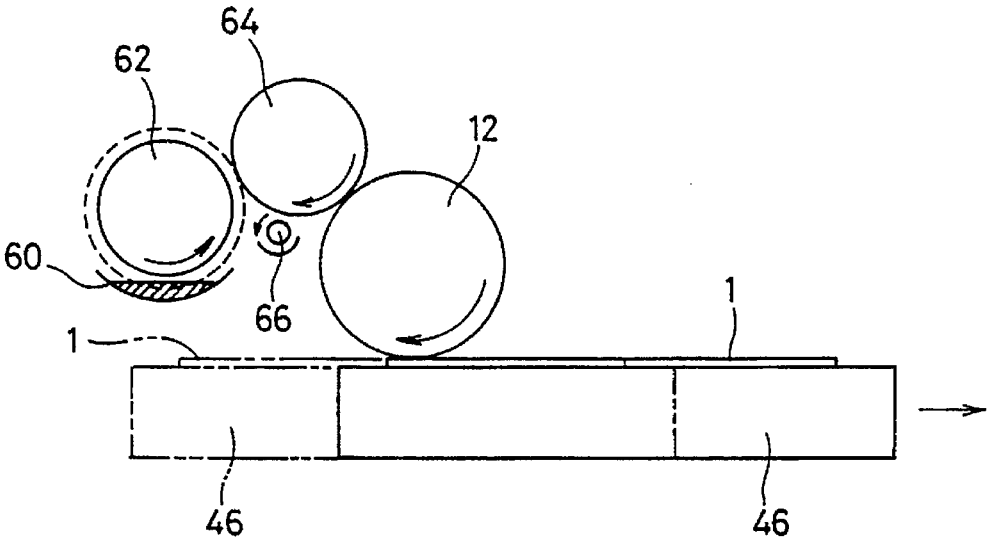
FIG. 4 schematically shows another example of a structure of a roll coater used in forming a thin film on a substrate.

FIG. 2 is a perspective view of the main part of a roll coater used in carrying out a method of applying coating fluid to the surface of a substrate according to an embodiment of the present invention. FIGS. 3 and 4 are schematic diagrams for describing the operation of a roll coater as it applies coating fluid, for example a photoresist liquid agent, onto the surface of a substrate, for example a liquid crystal glass substrate.

Referring to FIG. 2, a roll coater 10 includes an applicator roll 12, and a pair of coating fluid supplying rolls 14 and 16 having a pair of axes disposed parallel to each other in the same horizontal plane and above the applicator roll 12. Coating fluid supplying rolls 14 and 16 have their circumferential cylindrical surfaces in close proximity to each other. The upper part of the nip of coating fluid supplying rolls 14 and 16 form a reservoir 48. Coating fluid is provided to reservoir 48 by a coating fluid supplying mechanism (not shown). The coating fluid stored in reservoir 48 is supplied to the circumferential cylindrical surface of applicator roll 12 according to the rotation of roll 14.

The three rolls 12, 14 and 16 are held rotatably at both ends of respective axes by means of a pair of perpendicular supporting plates 18 and 20. A motor 22 for rotating applicator roll 12 is attached to the support plate 20. In a frame not shown, a swing mechanism 100 for swinging simultaneously support plates 18 and 20 upwards and downwards pivoting at spindles 49 is provided.

Referring to FIG. 2, a swing mechanism 100 includes a motor 24, a worm gear 26 fixed to the rotation shaft of motor 24, worm wheels 28 and 30 engaging worm gear 26, and vertical rods 32 and 34 fixed respectively to the worm wheels 28 and 30. The vertical rods 32 and 34 have female screws at respective center portions, and each female screw is engaged with a male screw portion formed in the left and right fixed members 36 and 38. Vertical rods 32 and 34 have their respective upper ends abutting against support plates 18 and 20, respectively, to support the same.

Roll coater 10 further includes devices 40 and 42 fixed to fixed members 36 and 38, respectively, for biasing support plates 18 and 20 constantly downwards, rails 44 disposed in a horizontal direction right beneath applicator roll 12 and in a direction orthogonal to applicator role 12, and a stage 46 guided by rails 44 and driven by a driving mechanism (not shown) to reciprocate in the horizontal direction for transporting a substrate. Stage 46 has a plurality of vacuum suction holes (not shown) formed at the top surface. Stage 46 further includes a vacuum suction mechanism (not shown) for holding substrate 1 by vacuum suction to the top surface of stage 46 via the vacuum suction holes.

Referring to FIG. 3, a roll coater includes an applicator roll 12, a fixed knife roll 50 having notch portions formed at the circumferential cylindrical surface thereof, and a metal roll 52 rotating in a direction identical to that of applicator roll 12 and in close proximity of knife roll 50 and in contact or close to applicator roll 12. A reservoir portion 54 for storing coating fluid is formed in the adjacent upper portions of knife roll 50 and metal roll 52. Metal roll 52 is provided with a scraper bar 56.

Referring to FIG. 4, a roll coater includes an applicator roll 12, a coating fluid reservoir tank 60, a gravure roll 62 disposed rotatably above and in the proximity of reservoir tank 60, an offset rubber roll 64 rotating in contact with gravure roll 62 and applicator roll 12, and a scraper roll 66 attached to offset rubber roll 64.

Using a roll coater of the above-described structures, coating fluid is applied to the surface of a substrate by a method set forth in the following.

Figure 5:
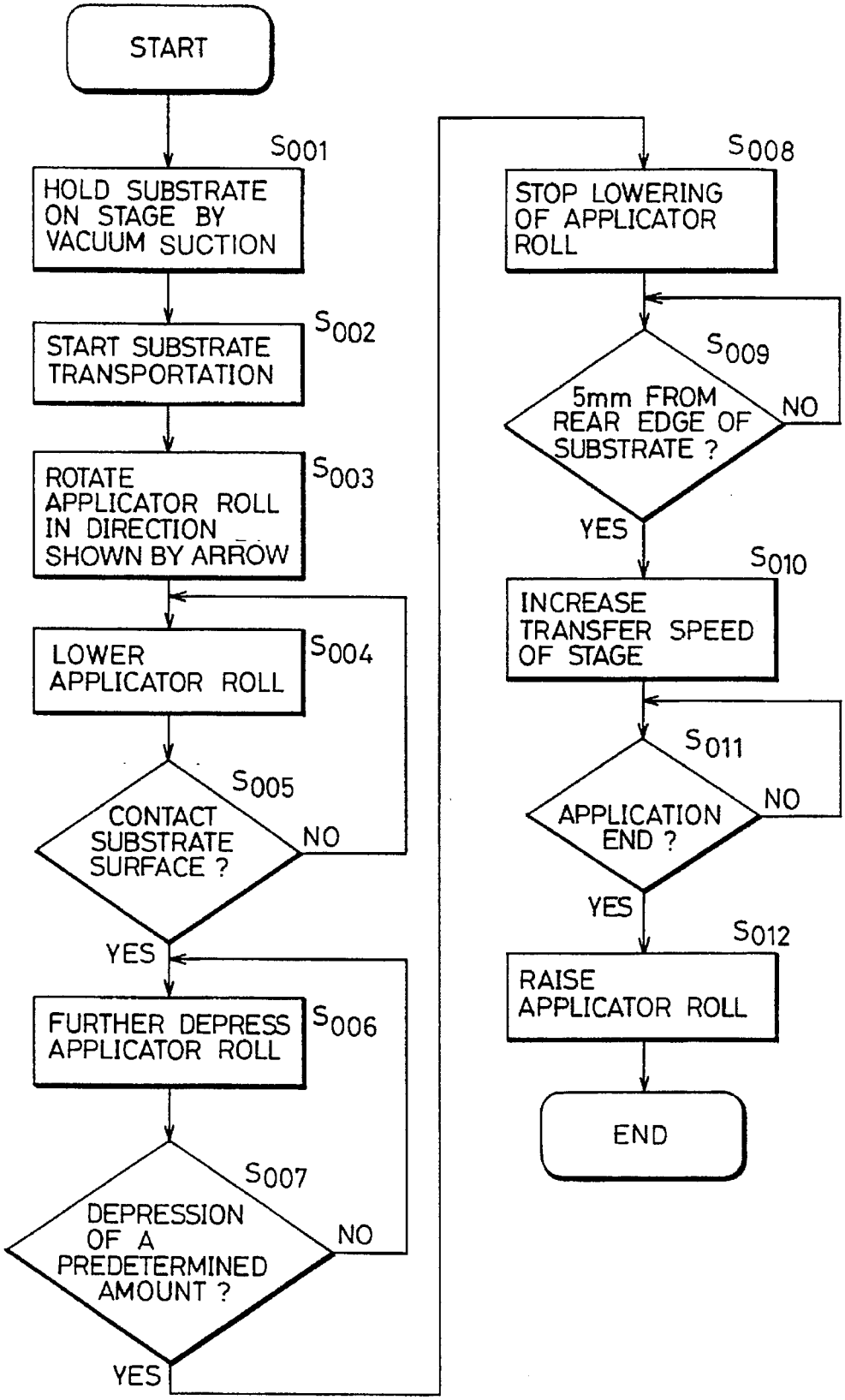
FIG. 5 is a flow chart of a method of changing the transportation speed of a substrate.

FIG. 5 is a flow chart for describing the operation by a roll coater.

Referring to FIGS. 2 and 5, stage 46 holds substrate 1 thereon by a vacuum suction mechanism not shown (step S001). Stage 46 is conveyed in the horizontal direction, whereby substrate 1 is located right below applicator roll 12 as shown in FIGS. 3 and 4 (steps S002). Applicator roll 12 is held in a position where the lowest portion of the circumferential cylindrical surface is slightly higher than the surface of substrate 1, for example higher by approximately 1 mm. Applicator roll 12 rotates in a direction indicated by the arrows in FIGS. 3 and 4 (showing the case of a reverse type applicator (step S003)). A thin film of coating fluid of a predetermined thickness is held on the circumferential cylindrical surface of applicator roll 12.

Applicator roll 12 is moved from the standby position downwards while substrate 1 is conveyed (S004). When the front edge of substrate 1 comes right on the perpendicular line going through the rotation shaft of applicator roll 12, i.e. when passing the lowest portion of applicator roll 12, applicator roll 12 is brought into contact with the surface of substrate 1 (S005). After applicator roll 12 comes into contact with the surface of substrate 1, applicator roll 12 is further moved downward, whereby applicator roll 12 is depressed against the surface of substrate 1 (S006). When applicator roll 12 is depressed by a predetermined amount, the downward movement of applicator roll 12 is stopped (S006–S008).

With applicator roll 12 abutted against the surface of substrate 1, applicator roll 12 is rotated while substrate 1 is conveyed in the horizontal direction. This causes the coating fluid to be applied to the surface of substrate 1 in uniform thickness. In this step, stage 46 is conveyed horizontally at a constant speed, and applicator roll 12 is rotated at a constant speed. As shown by the solid lines in FIGS. 3 and 4, when the circumferential cylindrical surface of applicator roll 12 forming contact with the surface of substrate 1 comes near the rear edge in the transportation direction x, for example, when applicator roll 12 forms contact with substrate 1 at approximately 5 mm from the rear edge of the substrate in the transportation direction x (S009), the transportation speed of stage 46 is increased while the rotating speed of applicator roll 12 is maintained at the constant (S010). When application of coating fluid to the surface of substrate 1 is completed (S011), applicator roll 12 is moved upward to the above-described standby position (S012).

The control of the horizontal movement of substrate 1 and the vertical movement of applicator roll 12 can be carried out by roll coater 10 as set forth in the following. Controlling motor 24 and the motor (not shown) of the driving mechanism of stage 46, the moving speed of applicator roll 12 in the vertical direction and the moving speed of stage 46 in the horizontal direction are adjusted interactively. The positions of applicator roll 12 and stage 46 are detected by a signal from an encoder (not shown) from each motor. The timing between applicator roll 12 and stage 46 is established on the basis of the detected positions of applicator roll 12 and stage 46. Similarly, by controlling the motor with the encoder output, the speed is changed when stage 46 reaches a predetermined position on the horizontal transportation path. By providing in advance the length of substrate 1 to the control device, the speed of stage 46 is changed when applicator roll 12 comes into contact with substrate 1 at a position 5 mm from the rear edge. Applicator roll 12 is retracted by a vertical driving mechanism when the rear edge of substrate 1 passes right below applicator roll 12.

Figure 6:
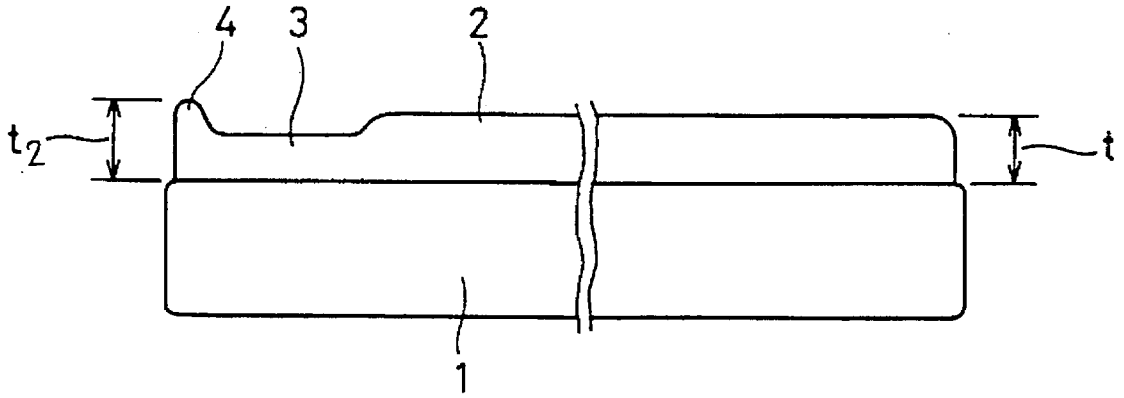
FIG. 6 is a partial sectional view of a substrate having a thin film formed on the surface thereof according to a method of the present invention.

As described above, the transportation speed of substrate 1 is increased in comparison with the former state when the circumferential cylindrical surface of applicator roll 12 comes into contact in the proximity of the rear edge of the surface of substrate 1 in the transportation direction x. As a result, the amount of coating fluid transferred from the circumferential cylindrical surface of applicator roll 12 adhering per unit area to the surface of substrate 1 is reduced from the prior state. Therefore, the thickness of the film formed near the rear edge of the surface of substrate 1 is reduced in comparison with the thickness of the film formed at the center portion of substrate 1. Thus, the amount of coating fluid projecting at the rear edge region of substrate 1 is reduced. The thickness (height) $t_2$ (FIG. 6) of projection 4 formed at the rear edge portion of substrate 1 is not so much greater than the thickness t of film 2 formed at the center region of substrate 1.

The present invention is not limited to the abovedescribed embodiment where applicator roll 12 is brought into contact with and depressed by a predetermined amount with substrate 1. The depressing operation after contact of the applicator roll with the substrate surface may be eliminated, and coating may be carried out with the depressed amount being 0 according to the film thickness of the required film or type of coating fluid, as in the case where a lower film thickness is required. The downward movement of applicator roll 12 may be ceased after applicator roll 12 comes in contact with the surface of substrate 1. That is to say, steps S006 and S007 in FIG. 5 may be omitted.

The results of experiments comparing the state of thin films formed by a conventional method and by a method of the present invention using the roll coater of the structure shown in FIG. 3 will be described hereinafter.

The conventional method was carried out with the peripheral speeds of metal roll 52 and applicator roll 12 at 3.5 m/minute and 4.5 m/minute, respectively and with the horizontal transfer speed of substrate 1 (stage 46) at a constant speed of 5.25 m/minute.

The method of the present invention was carried out with the peripheral speeds of metal roll 52 and applicator roll 12 constant at of 3.5 m/minute and 4.5 m/minute, respectively. The horizontal transfer speed of substrate 1 (stage 46) is initially 5.25 m/minute, and then switched to 8 m/minute when the circumferential cylindrical surface of applicator roll 12 contacting the surface of substrate 1 comes to the proximity of the rear edge.

Figure 1:
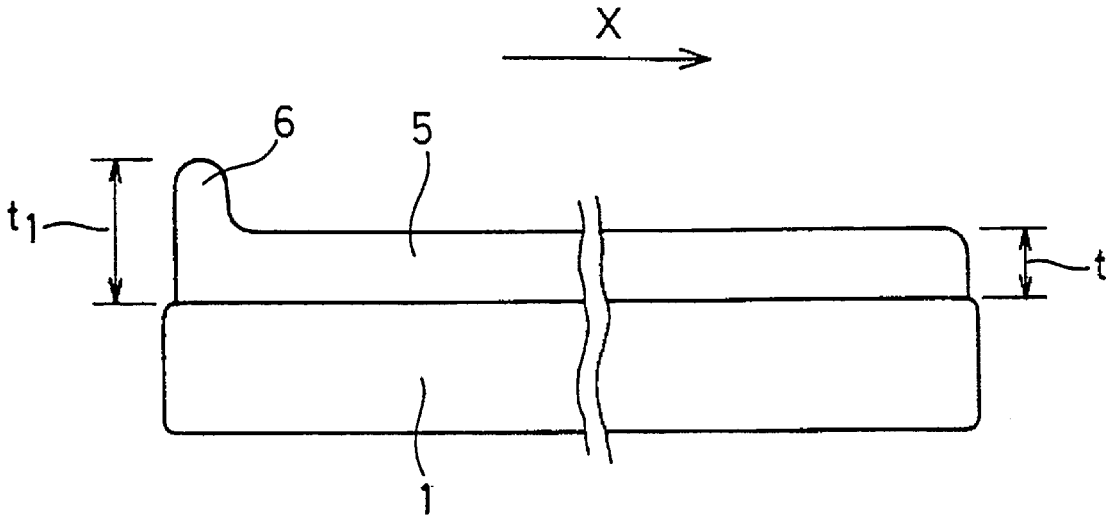
FIG. 1 PRIOR ART
FIG. 1 is a partial sectional view of a substrate having a thin film formed thereon by a conventional method.

When coating fluid was applied to the substrate surface according to the conventional method, the thickness t of a film 5 formed at the center portion of substrate 1 was 1.95 μm, as shown in FIG. 1 and the thickness t1 of projection portion 6 at the rear edge portion of substrate 1 was 3.16 μm (t1=1.62t). In the case according to the present invention, the thickness t of a film 2 formed at the center portion of substrate 1 was 1.95 μm and the thickness t2 of projection portion 4 at the rear edge portion of substrate 1 was 2.03 μm (t2=1.04t). The projection in the proximity of the rear edge of substrate 1 formed by the method according to the present invention was reduced more than 50% in comparison with the projection formed by using conventional method, and using the method according to the instant invention film thickness at the trailing end of the substrate was substantially equal to that of other portions of the film.

In the above description, the transfer speed of the substrate is increased while the rotating speed of the applicator roll is maintained at a constant speed when the circumferential cylindrical surface of the applicator roll comes into contact with the surface of the substrate in the proximity of the rear edge in the transportation direction. Thus, the thickness of the film formed in the proximity of the rear edge of the surface of the substrate in the transportation direction was reduced in comparison with the center portion of the substrate to reduce the projection of the thin film at the rear edge portion of the substrate. However, the method of the present invention is not limited to this procedure, and any procedure may be taken as long as the amount of coating fluid supplied per unit area onto the rear edge area of the surface of the substrate is reduced. For example, the rotating speed of the application roll may be lowered while maintaining the transfer speed of the substrate at a constant rate when the circumferential cylindrical surface of the applicator roll comes into contact with the surface of the substrate in the proximity of the rear edge thereof.

Figure 7:
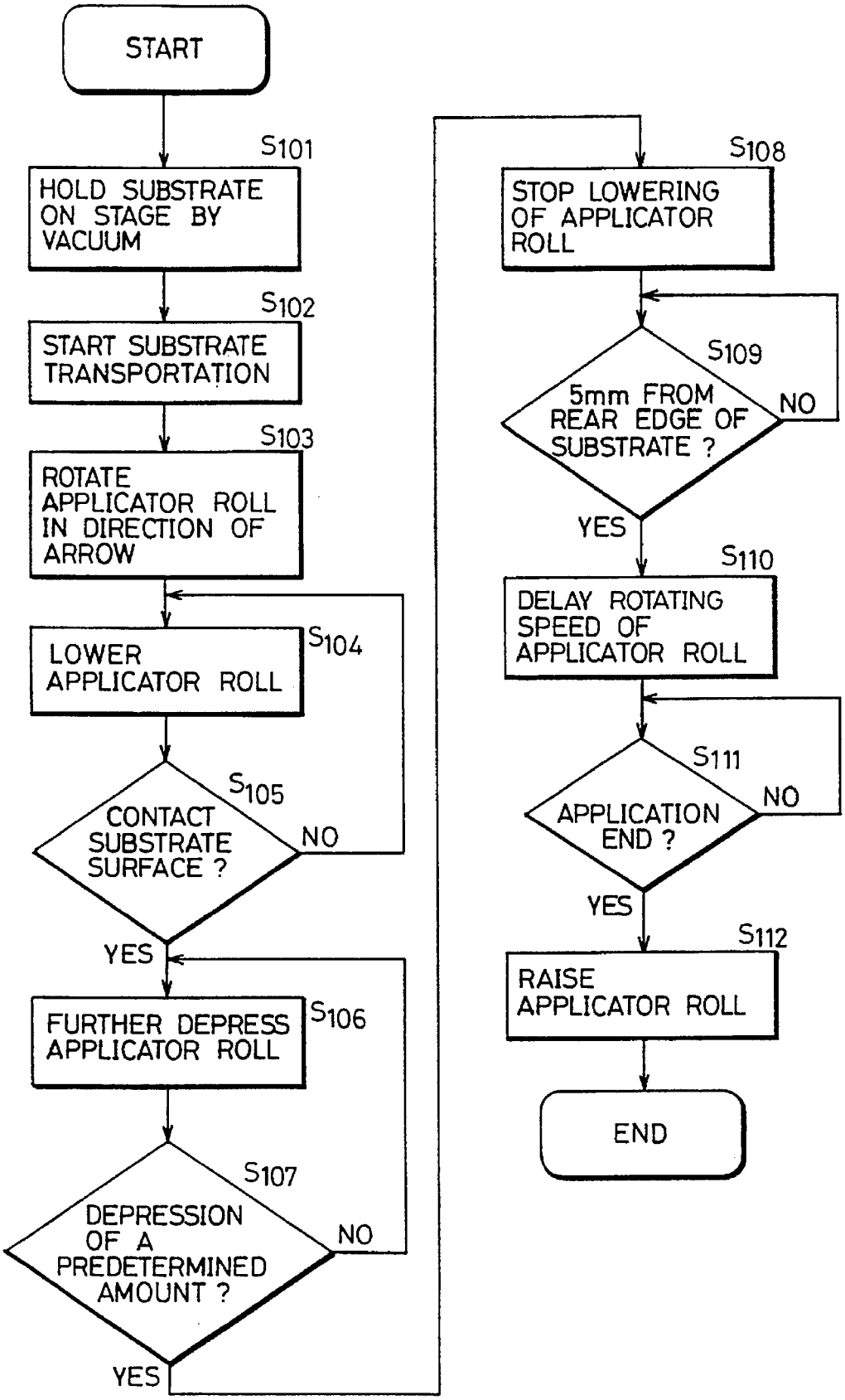
FIG. 7 is a flow chart of a method of delaying the rotating speed of an applicator roll.

The flow chart in FIG. 7 shows the case where the rotating speed of the applicator roll is lowered while the transfer speed of the substrate is maintained at a constant. The steps S101–S109, S111, and S112 in the flow chart of FIG. 7 are identical to the steps S001–S009, S011 and S012 shown in the flow chart of FIG. 5. The flow chart of FIG. 7 differs from that of FIG. 5 in step S110. In comparison with step S010 of FIG. 5, step S110 has the rotating speed of the applicator roll lowered. The amount of coating fluid supplied from applicator roll per unit area to the surface of substrate 1 is reduced, so that the thickness of the film formed on the surface of substrate 1 is reduced.

The control may be set so that the amount of coating fluid supplied to the circumferential cylindrical surface of the applicator roll is reduced when the circumferential cylindrical surface of the applicator roll comes into contact with the surface of the substrate in the proximity of the rear edge. The amount of coating fluid applied from the coating fluid supplying roll to the circumferential cylindrical surface of the applicator roll is reduced as follows. Referring to the roll coater of FIG. 2, knife roll 50 serving as a doctor is set in a close departable manner within a predetermined range with respect to metal roll 52. Control is established so that the distance between the circumferential cylindrical faces of metal roll 52 and knife roll 50 is reduced when the circumferential cylindrical surface of applicator roll 12 comes into contact with the surface of substrate 1 in the proximity of the rear edge.

Figure 8:
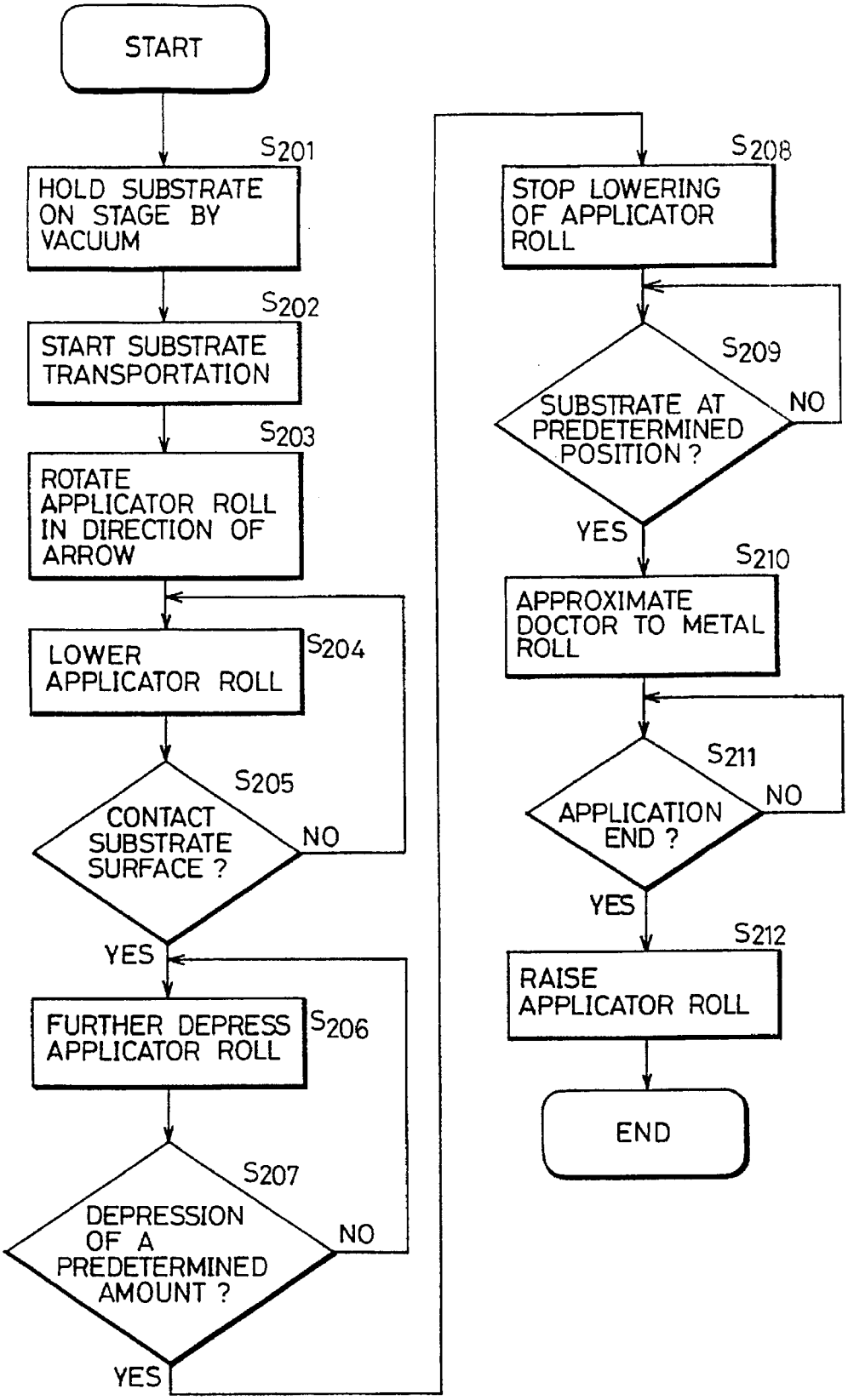
FIG. 8 is a flow chart of a method for reducing the supply of coating fluid to an applicator roll.

A schematic flow chart of this control is shown in FIG. 8. Referring to FIG. 8, steps S201–S209, S211, and S219 are identical to the steps S001–S009, S011, S012 of FIG. 5. The flow chart of FIG. 8 differs from that of FIG. 5 in step S210. In comparison with step S010 of FIG. 5, step S210 moves knife roll 50 serving as a doctor so that the distance between knife roll 50 and metal roll 52 is reduced. This causes the amount of coating fluid applied to the circumferential cylindrical surface of metal roll 52 to be reduced. Thus, the amount of coating liquid transferred from the circumferential cylindrical surface of metal roll 52 to that of applicator roll 12 is reduced. As a result, the amount of coating fluid supplied from applicator roll 12 per unit area to the surface of substrate 1 is reduced, whereby the thickness of the film formed on the surface of substrate 1 is reduced. The moving timing of knife roll 50 should be set to an appropriate one determined by experiments and the like in advance.

The doctor is not limited to the above-described knife roll 50, and generally-used doctors such as a doctor bar or the like, may be used.

According to the present invention, projection of a film at the rear edge portion of the substrate is reduced in comparison with that by a conventional method. With this reduced rear edge projection, when a photoresist liquid agent is applied as a coating fluid to the surface of a substrate, sufficient contact can be obtained between the substrate and the exposure mask in the succeeding process of contact exposure. Thereby maintaining quality of the resulting exposure. Furthermore, there is no possibility that undeveloped sections of the projection portion of the resist at the rear edge portion of the substrate will remain thereon in a subsequent developing process.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A method for utilizing an applicator roll to form a coating of film having a thickness on a surface of a substrate having a rear edge by applying coating liquid on the surface of said substrate, said method comprising the steps of:

(a) supplying said coating liquid on a circumferential surface of said applicator roll;

(b) rotating said applicator roll such that said circumferential surface of said applicator roll moves in a first direction;

(c) contacting said substrate with said circumferential surface at a start position;

(d) transporting said substrate in a second direction opposed to said first direction of said circumferential surface at said start position, and at a speed of transportation relative to said applicator roll, while continuously contacting the circumferential surface of said applicator roll with the surface of said substrate, from the start position at which said contact is started, to an end position at which end position said contact is terminated, for transferring coating liquid supplied on the circumferential surface of said applicator roll to the surface of said substrate; and (e) increasing the speed of transportation of said substrate before said substrate is transported to said end position, relative to the speed of transportation when said substrate is at said start position for reducing an amount of said coating liquid transferred from the circumferential surface of said applicator roll to the surface of said substrate before said substrate is transported to said end position, relative to an amount of said coating liquid transferred from the circumferential surface of said applicator roll to the surface of said substrate when said substrate is at said start position.

2. The method of claim 1, wherein said circumferential surface of said applicator roll is formed of an elastic material, the method further comprising the step of depressing said elastic circumferential surface applicator roll against said substrate.

3. A method for utilizing an applicator roll to form a coating of film having a thickness on an upper surface of a substrate having a rear edge by applying coating liquid on the surface of said substrate, said method comprising the steps of:

(a) supplying said coating liquid on a circumferential surface of said applicator roll;

(b) transporting said substrate relative to said applicator roll while continuously contacting the circumferential surface of said applicator roll with the upper surface of said substrate, from a start position at which said contact is started, to an end position at which said contact is terminated, for transferring coating liquid supplied on the circumferential surface of said applicator roll to the surface of said substrate;

(c) rotating said applicator roll in a direction so that the circumferential surface of said applicator roll moves opposite to a direction along which the surface of said substrate is transported at a position in which the circumferential surface of said applicator roll is contacted with the surface of said substrate;

(d) rotating said applicator roll at a speed of rotation while contacting the circumferential surface of said applicator roll with the surface of said substrate, for transferring coating liquid supplied to the circumferential surface of said applicator roll to the surface of said substrate; and (e) reducing the rotational speed of said applicator roll before said substrate is transported to said end position relative to the rotational speed when said substrate is at said start position, for reducing an amount of said coating liquid transferred from the circumferential surface of said applicator roll to the surface of said substrate before said substrate is transported to said end position, relative to an amount of said coating liquid transferred from the circumferential surface of said applicator roll to the surface of said substrate when said substrate is at said start position.

4. The method of claim 3, wherein said circumferential surface of said applicator roll is formed of an elastic material, the method further comprising the step of depressing said elastic circumferential surface applicator roll against said substrate.

5. A method for utilizing an applicator roll to form a coating of film having a thickness on a surface of a substrate having a rear edge by applying coating liquid on the surface of said substrate, said method comprising the steps of:

(a) supplying said coating liquid on a circumferential surface of said applicator roll;

(b) rotating said applicator roll such that said circumferential surface of said applicator roll moves in a first direction;

(c) contacting said substrate with said circumferential surface at a start position;

(d) transporting said substrate in a second direction opposite to said first direction of said circumferential surface of said applicator roll at said start position while continuously contacting the circumferential surface of said applicator roll with the surface of said substrate, from said start position at which said contact is started, to an end position at which said contact is terminated, for transferring coating liquid supplied on the circumferential surface of said applicator roll to the surface of said substrate; and (e) reducing an amount of coating liquid to be transferred to the surface of said applicator roll before said substrate is transported to said end position relative to an amount transferred to the surface of said applicator roll when said substrate is at said start position for reducing an amount of said coating liquid transferred from the circumferential surface of said applicator roll to the surface of said substrate before said substrate is transported to said end position, relative to an amount of said coating liquid transferred from the circumferential surface of said applicator roll to the surface of said substrate when said substrate is at said start position.

6. The method of claim 5, wherein said circumferential surface of said applicator roll is formed of an elastic material, the method further comprising the step of depressing said elastic circumferential surface applicator roll against said substrate.

* * * * *